US006530966B1

(12) United States Patent
Kriech et al.

(10) Patent No.: US 6,530,966 B1
(45) Date of Patent: Mar. 11, 2003

(54) COAL BINDER COMPOSITIONS AND METHODS

(76) Inventors: Anthony J. Kriech, 9029 Shetland La., Indianapolis, IN (US) 46278; Todd E. Dobbs, 15802 River Birch Rd., Westfield, IN (US) 46074

( * ) Notice: Subject to any disclaimer, the term of this patent is extended or adjusted under 35 U.S.C. 154(b) by 0 days.

(21) Appl. No.: 09/595,066

(22) Filed: Jun. 16, 2000

(51) Int. Cl.[7] ..... C10L 5/00; C10L 5/02

(52) U.S. Cl. ..... 44/542; 44/301; 44/500; 44/545; 44/564; 44/566; 44/569; 44/570; 44/572; 44/593

(58) Field of Search ..... 44/551, 578, 301, 44/542, 500, 545, 564, 566, 569, 570, 572, 593

(56) References Cited

U.S. PATENT DOCUMENTS

| | | | | |
|---|---|---|---|---|
| 44,994 | A | | 11/1864 | Cornell |
| 852,025 | A | | 4/1907 | Mashek |
| 4,094,746 | A | | 6/1978 | Masciantonia et al. |
| 4,234,320 | A | | 11/1980 | Verschuur |
| 4,357,145 | A | | 11/1982 | Dondelewski |
| 4,388,152 | A | | 6/1983 | Wasson et al. |
| 4,395,265 | A | | 7/1983 | Reilly et al. |
| 4,675,026 | A | * | 6/1987 | Reimer et al. ..... 44/301 |
| 4,828,573 | A | | 5/1989 | Jelks |
| 4,830,637 | A | | 5/1989 | Wasson |
| 4,867,911 | A | | 9/1989 | Shortt et al. |
| 5,089,540 | A | | 2/1992 | Armbruster |
| 5,244,473 | A | | 9/1993 | Sardessai |
| 5,368,616 | A | | 11/1994 | Natschke et al. |
| 5,453,103 | A | | 9/1995 | Ford |
| 5,487,764 | A | | 1/1996 | Ford, Jr. |
| 5,589,118 | A | | 12/1996 | Ford, Jr. et al. |
| 5,599,361 | A | | 2/1997 | Ford, Jr. |
| 5,738,694 | A | | 4/1998 | Ford, Jr. et al. |
| 5,743,924 | A | | 4/1998 | Dospoy et al. |
| 5,752,993 | A | | 5/1998 | Eatough et al. |
| 5,893,946 | A | | 4/1999 | Landis |
| 5,916,826 | A | | 6/1999 | White |
| 6,013,116 | A | | 1/2000 | Major et al. |

* cited by examiner

*Primary Examiner*—Margaret Medley
(74) *Attorney, Agent, or Firm*—Baker & Daniels

(57) ABSTRACT

Binder compositions for converting coal waste into fuel including a distillable petroleum hydrocarbon emulsified with a surfactant and water are provided. The invention also includes methods for making the binder compositions. The methods include blending a distillable petroleum hydrocarbon petroleum hydrocarbon with water and a surfactant. In another aspect, a fuel product is provided which includes the reaction product of carbonaceous fine particles and a binder composition of this invention. The binder composition is provided in an amount necessary to increase the hydrophobic characteristics of the carbonaceous fine particles and bring about a statistically significant change in their chemistry. In one embodiment the binder composition is present in an amount between about 1.5 percent and about 4.0 percent of the total weight. Methods are also provided for making fuel from fine carbonaceous materials, which include exposing the carbonaceous materials to a binder composition of this invention.

16 Claims, 11 Drawing Sheets

COAL BINDER COMPOSITIONS AND METHODS

FIELD OF THE INVENTION

The present invention relates generally to the field of reclaiming and utilizing waste carbonaceous materials. More specifically, the invention relates to coal additive emulsions.

BACKGROUND OF THE INVENTION

Coal is used as an energy source in many industrial settings. Regrettably, there are many problems that accompany the industrial use of coal to generate heat. These problems arise during mining, preparation prior to shipping, storage, preparation prior to use and the use of coal.

The mining of coal gives rise to the first of these problems. Typically, after handling and cleaning is completed, about 15–20% of the coal mined consists of fines ranging in size from powder to small granules. For the most part, these fines are not directly usable, thereby leaving great quantities of material that is wasted and represents a hazardous and expensive disposal problem. Typically, coal fines are disposed of at or near the mine site in unsightly piles, trenches or ponds. The fines material from mining operations are frequently recovered in the form of a wet filter containing about 20–30% moisture, depending upon its size, distribution and ash content. Currently, there are over two billion tons of discarded coal fines throughout the United States. While a portion of the coal fines can be combined with coarser fractions of mine production for sale, the inclusion of all fines often reduces the quality of the product below market requirements. Accordingly, coal fines handling, storage and disposal operations represent a significant and unproductive expense for the industry.

The next problem that contributes to the underutilization of coal fines for conventional uses is their relatively high moisture content after processing in coal preparation plants. The heating value of coal is reduced as its moisture content increases. Since the value of coal depends on its heating value, it follows that the price can be increased by reducing the moisture content. Therefore, the coal industry typically reduces the moisture in coal prior to shipment to utilities and industrial customers in order to increase its heating value and price. This reduction in moisture increases the efficiency of power plants and decreases transportation costs. The process of reducing coal moisture, though, further contributes to the problem of coal fines production because as water is removed, the coal structure is weakened leading to the production of further coal particles. Thus, coal drying operations are yet another source of fines.

Once mined, prepared and shipped, the coal is typically stored prior to use. During storage two other problems arise. First, the coal that had been expensively reduced in water content by drying now sits and absorbs ambient water. This, as explained above, lowers its BTU value. Second, the dry coal is brittle and fines that contribute to coal dust problems are produced. These dust problems are a nuisance to neighbors and may, in some cases, violate local fugitive dust emission regulations.

In some cases the coal is transformed into coke prior to use. Coke is essentially a high carbon content, component used primarily in steel making, blast furnaces and other industrial applications. It is made from metallurgical grade coal that is heated anaerobically in large ovens. The volatile matter is driven off, leaving fixed carbon and leading to the flaking off of coal fines. As such, the coke making process is yet another source of coal fines.

Lastly, heating coal in furnaces gives rise to two important environmental concerns, sulfur and ash. Coal that is high in sulfur cannot be used efficiently as a fuel source because regulations prohibit sulfur stack emissions. Coal that produces a high ash content cannot efficiently be used either due to regulations prohibiting particulate matter emissions. These regulations are commonly referred to as pm-2.5. This is particulate matter above 2.5 nanometers in size. This particulate matter contributes to visibility problems and is thought to be the cause of the recent alarming increase in the incidence of asthma. The visibility problems are recognized where the opacity of the stack plume is high, in that it is less transparent. Ash is such a problem that a large body of research has been devoted to additives that aid complete combustion without ash production. These chemical additives have been added with feedstock fuel but, problems regarding consistent levels of additives have remained an issue.

As a result of these problems, as well as the strict customer quality demands and stringent regulation of mine waste disposal practices to satisfy environmental standards, coal fine utilization has been recently reexamined by the industry. In the past, fines have been used mostly for manufacture and briquettes for home and commercial heating. Coal briquetting technology focused on low-pressure agglomeration of coal fines, using a binder, typically of coal tar origin, to hold individual particles together. This technology flourished during the early part of the century, when coal briquette products were utilized as home heating fuel, but this application has essentially disappeared since the end of World War II due to a shift to other more convenient sources of fuel. Therefore, this opportunity for commercial utilization of coal fines has been drastically reduced.

Recently, as the amount of available landfill space dwindles, disposal costs have risen, thus increasing public pressure to find alternatives to land fills for waste coal products. As land fill costs rise the economics of using waste as fuel has become more favorable. Not only does the use of waste as a fuel save disposal costs, but often these wastes are closer to potential customers than are sources of raw coal, thus reducing transportation costs.

In spite of the desirability to reclaim coal waste for fuel, the small size of coal fines presents a significant problem when they are used industrially. In a dry state, the fines are generally predominantly passable through a 28 mesh screen. Industrial coal furnaces generate a high velocity vortex as heat rises through the exhaust stack. When fine particles enter this vortex they are simply carried up the exhaust stack. By being carried up the exhaust stack the energy value of the coal is not utilized and the particles contribute further to the problem of particulate matter emissions. Also the use of unbound fines is unpredictable. This unpredictability prohibits a furnace operator from uniformly feeding the furnace so the furnace can operate in an efficient manner. Therefore, to be useful to industry, the fines must be uniformly agglomerated in some way.

One approach has been to design specialized boilers to burn the specified waste. Unfortunately, such specialized boilers are prohibitively expensive. Wastes can also be blended with coal before combustion in a conventional boiler, but the waste materials often segregate during storage and handling, so as to cause slugs of waste to enter the boiler. Normally, the heat content and combustion characteristics of waste are very different from coal. If wastes enter the boiler as slugs, the operators must deal with a high variable feed and boiler efficiency may drop. Also, wastes are typically more difficult to handle than coal, potentially causing feed shoots and vents to plug. In sum, these approaches to using waste as fuel have been unsuccessful in that the particles are not uniformly agglomerated.

Numerous processes have been proposed and implemented in the past for agglomerating particles. Most forms of agglomeration methods use either an organic binder such as lignosulfonate, petroleum pitch, latex or polymers, or an inorganic binder such as cement or bentonite. Binder choice depends principally on the cost of the binder and product quality required.

U.S. Pat. No. 44,994 to Cornell, issued over a century ago, teaches that coal dust can be pelletized by saturating it with a solution of starch, pressing it, or otherwise forming it into blocks or lumps, and drying it in the sun or by other suitable means. When these starch-based binders are used, the resulting green pellets must be dried to achieve acceptable fuel performance and reduce transportation costs. Also, starches and sulfates have no apparent ability to completely fuse the coal fines. Moreover, when rewetted, the bond weakens. Thus, pellets made with starch and sulphate binders are neither strong nor water proof. Sulfates also add sulfur to the coal which produces undesirable sulfur oxides and stack gases, which is direct noncompliance with the clean air regulations.

U.S. Pat. No. 852,025 to Mashek discloses preparing coal for briquetting by drying and heating it, mixing an asphaltic binder material, then heating, cooling, and compacting the mixture. More recently, U.S. Pat. No. 5,752,993 to Eatough discloses a binder composition made up of tar, acid, a polymeric binder, water and, if necessary, a surfactant to aid in wetting the carbonaceous material. These asphaltic and tar binder compositions are well known in the art. However, they do not sufficiently prevent the bound material from absorbing water and they are not suitable for industrial use due to there soft and "gummy" characteristics. These binders produce a product that fouls the feed lines to furnaces by clogging the inlets. Neither can they be transported or stored without absorbing water and either degrading or decreasing in BTU content.

Many other natural and synthetic particles have been utilized as binders for coal fines. U.S. Pat. No. 5,244,473 to Sardessai discloses a binder for coal fines made from a phenolaldehyde resin mixed with a polyisocyanate in the presence of a catalyst. U.S. Pat. No. 5,089,540 to Armbruster discloses a binder for foundry molds made from an extra cured alkaline phenolic resin, which can be enhanced by conditioning the reclaimed sand with a solution containing an amine and a saline. Likewise, U.S. Pat. No. 5,487,764 to Ford discloses the use of a binder composition made up of a styrene in a hygroscopic solvent (methyl ethyl ketone), polyvinyl acetate and water. Regrettably these prior art binders are derived from useful and often expensive raw materials such as natural and synthetic polymer, thereby adding significantly to the overall cost of the briquette and making there use cost prohibitive.

The use of such binders requires water. Unfortunately, the heating value of coal decreases as moisture content increases. Moreover, large amounts of water are associated with the fine coal either because it is being recovered from black water ponds or because the fines are slurried with the binder to achieve the desired coating. Regardless, water in the final product is undesirable as it is useless weight, increasing transportation costs and, as a result, decreasing the BTU content per ton. As a result, the prior art has failed to produce synthetic fuels that have sufficient heating value.

Therefore, a need has remained for an inexpensive, yet reliable, coal binder that, when used to produce a fuel product, produces a strong, weather resistant, environmentally compliant fuel product.

The government has provided yet another incentive: a tax credit to those who create synthetic fuels. To qualify for this credit fuels must undergo a "significant chemical change." The change is measured by comparing the synthetic fuel product to ingredients used to make it. Laboratory measurements of the feed stock coal, binders, additives and/or supplements are composited and compared to the synthetic fuel to verify that the chemistry of the synthetic fuel cannot be predicted from the ingredients. If the chemistry of the product is different than a mere mixture of the ingredients and the differences are statistically significant, the fuel may be deemed qualified. With the above binder shortcomings in mind it is apparent there is still need for improved binders and briquetting processes.

SUMMARY OF THE INVENTION

In accordance with the invention binder compositions are provided comprising a distillable petroleum hydrocarbon emulsified with a surfactant and water. In one embodiment, the binder composition includes the addition of a base. The petroleum hydrocarbons are emulsified with a surfactant and water by conventional means. In a particular embodiment of the invention the binder is emulsified in a colloid mill.

In one specific embodiment, a method is provided for making a binder composition for converting carbonaceous materials into fuel. The method includes blending a distillable petroleum hydrocarbon with water and a surfactant.

In another aspect a fuel product is provided which includes the reaction product of fine carbonaceous materials and binder composition including a petroleum hydrocarbon emulsified with a surfactant and water in an amount necessary to increase the hydrophobic characteristics of the fine carbonaceous materials.

In one aspect a method for using the binder composition to bind fine carbonaceous material is disclosed wherein the fine carbonaceous materials are exposed to the binder composition to produce fuel. In one embodiment the binder composition is present in an amount between about 1.5 percent and about 4.0 percent of the total weight. In another embodiment the binder composition is used as a vehicle for the addition of chemical additives. These additives are typically added to reduce ashing. In still another embodiment the fuel is solidified by conventional means into a briquette or pellet.

One object of the invention is to provide an inexpensive coal binder that can be used to reliable produce a strong, weather-resistant and environmentally compliant fuel product from coal waste.

Other objects and further benefits of the present invention will become apparent to persons of ordinary skill in the art from the following written description and accompanying Figures.

DESCRIPTION OF THE PREFERRED EMBODIMENTS

Figure 1:
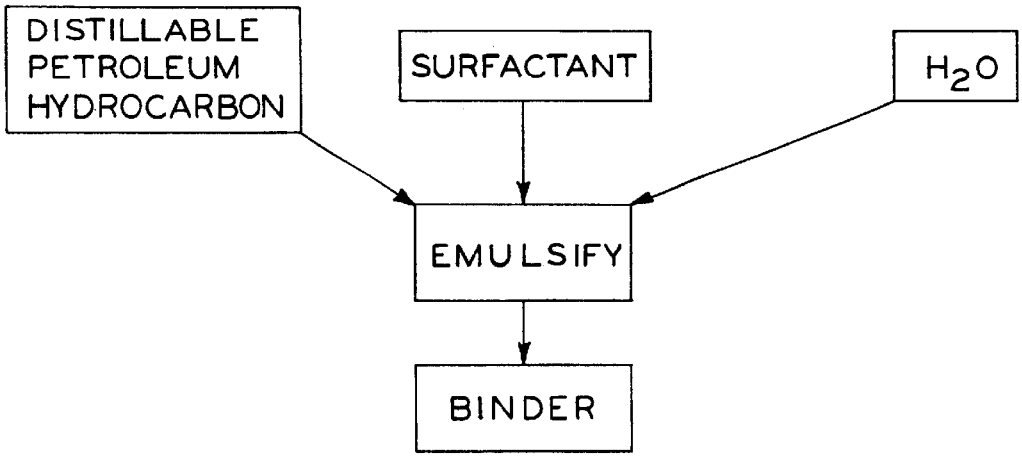
FIG. 1 is a flowchart of one embodiment of the invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

The present invention is based on the discovery of compositions that effectively and inexpensively convert coal waste products into fuels with high BTU and desirable handling characteristics. The compositions include low sulfur binders that increase the hydrophobic characteristics of coal fines. The hydrophobic surfaces reduce water absorption and as a result increase the BTU content of the resulting fuel material. In addition, the binder composition does not increase the ash content of the material, and it has been recognized that fuels bound with this invention reduce emission stack opacity levels. The invention further includes methods for making the binder compositions and methods for converting carbonaceous materials into fuels.

According to one embodiment, the present invention provides binder compositions for converting fine carbonaceous materials, or coal waste, into fuel. Any suitable waste material is contemplated, including, but not limited to: coke breeze, coke fines, finely divided metallurgic coke, coal fines and/or revert materials and other carbonaceous materials with a fine particle size. The carbonaceous materials are typically reclaimed from coal mining, production and use waste. The binder compositions of this invention include a distillable petroleum hydrocarbon emulsified with a surfactant and water.

Because hydrocarbons are typically categorized in the art based on the fraction they are present in during distillation from crude oil the petroleum hydrocarbons utilized in this invention are likewise categorized. These petroleum hydrocarbons include those hydrocarbons that are distillable, with or without the aid of vacuum. This includes those hydrocarbons that boil between the temperatures of 0° C. and 450° C. without vacuum, for example: petroleum gas, gasoline, kerosene, diesel, and heavy oil. It also includes those hydrocarbons that are distilled under vacuum, for example: motor oils, petroleum "jelly" and "wax." It does not include those hydrocarbons that do not distill, for example: asphalt and petroleum coke. But, petroleum hydrocarbon does include those hydrocarbons generated as a result of "cracking" those hydrocarbons that do not distill.

The following is a list of the petroleum hydrocarbons that have been used successfully by the inventors: #6 fuel oil, napthenic lubricants, paraffinic lubricants, crank case oil, and bright stocks. Preferably the petroleum hydrocarbons will have a Cleveland open cup flash point greater that 120° C. (250° F.) to avoid premature combustion.

According to this invention, petroleum hydrocarbon is preferably present in an amount between about 25 percent and 70 percent of the total weight of the binder composition. The invention contemplates that lower amounts of petroleum hydrocarbon binder may be used. In some cases, lower amounts of binder may even bind a larger amount of material because the material to be bound is less concentrated in the water component. When the hydrocarbon amount is lowered, a correspondingly larger amount of binder may be required. In a particular preferred embodiment of this invention, the presence of the petroleum hydrocarbon is at about 60 percent of the total weight of the composition.

The particular surfactant is not critical. The invention contemplates any suitable surfactant including anionic, cationic and nonionic surfactants. If the end product is to be used industrially, the surfactant will preferably be a low sulfur surfactant. Useful surfactants include: anionic surfacats such as, fatty acids, rosin acids, tall oil, tallow fatty acids or lignosulfonates; cationic surfactants including, diamines or quaternary amine salts; and nonionic surfactants like nonyl phenol. The surfactant is preferably added to an amount between about 0.25 percent and 5 percent of the total weight of the binder composition. In a particular preferred embodiment of this invention, the surfactant is about 2.0 percent of the total weight of the composition.

The water component of the binders of this invention can be any potable water, including softened or process waters form non hazardous water sources. The water component is added in an amount that makes up the remainder of the composition. In a preferred embodiment of this invention, the water content is about 40 percent of the total weight of the composition.

In some embodiments, a base is added to the binder. The base is preferably any inexpensive base with properties similar to those of sodium hydroxide, lithium hydroxide or potassium hydroxide. In a specific embodiment, sodium hydroxide is added. Preferably, the base salt is added within the range of about 0.1 percent to about 5.0 percent of the binder composition by weight, with the most preferred amount being about 0.25 percent. Adding base makes the solution alkaline or caustic. The addition of base aids in fusing small particulates during combustion. This fusing prevents the formation of fly ash and creates more bottom ash. When less fly ash is created it has been observed that the opacity in the stack is significantly reduced.

Figure 2:
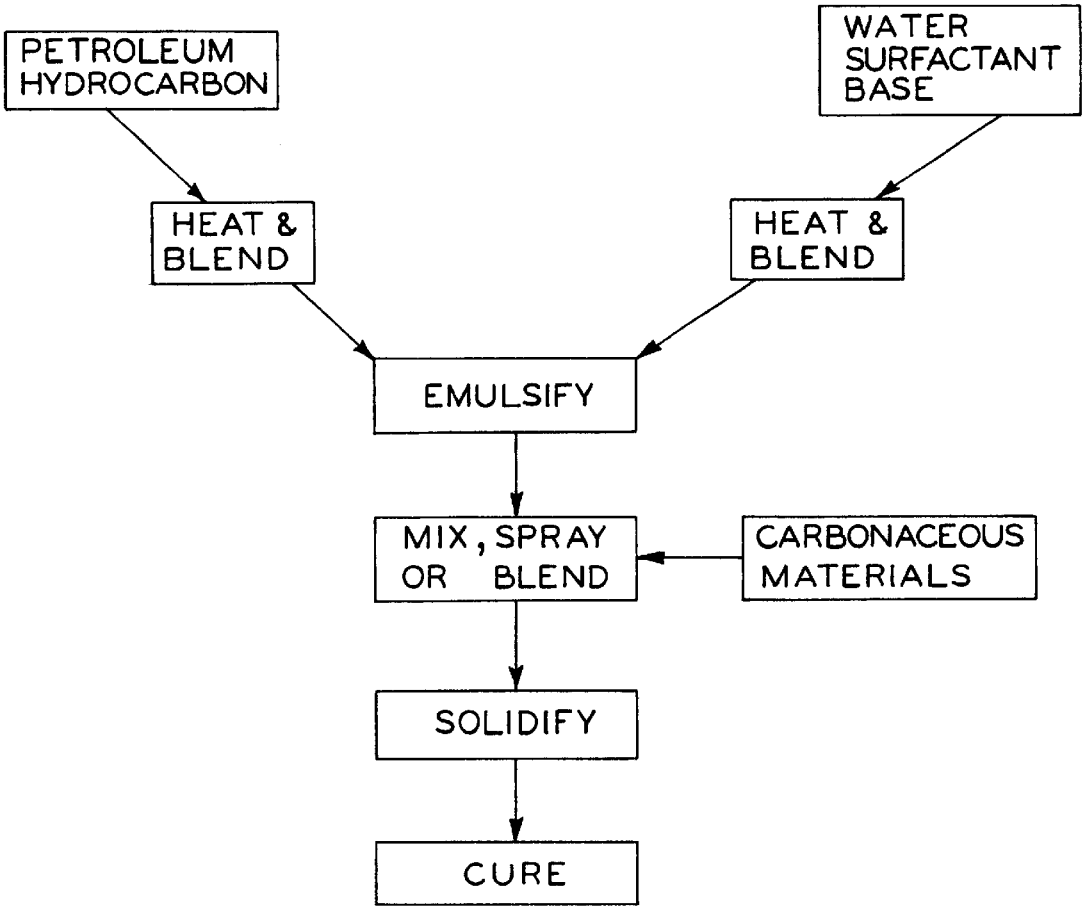
FIG. 2 is a flowchart of another embodiment of the invention.

Referring now to FIG. 1, the invention includes methods of making the binders. The methods include emulsifying petroleum hydrocarbon, surfactant and water in any suitable fashion. In one specific embodiment depicted in FIG. 2, a petroleum hydrocarbon such as Fuel Oil is heated to about 77° C. (170° F.). A surfactant mix is prepared by heating water to about 38° C. (100° F.). The invention does not require heating, but in some cases heating is preferred. The solutions can be heated to higher temperatures but, it is desirable that the temperature of the binder after the solutions are mixed be below boiling temperature, 100° C. (212° F.). A base is then preferably added to the water to make the water caustic. A surfactant, such as tall oil fatty acid, is then mixed into the caustic water to neutralize the fatty acid. The fuel oil and surfactant containing water are then blended at approximately 40% water and surfactant mix/60% petroleum hydrocarbon in any appropriate manner. In one particular embodiment, the components are emulsified in a colloid mill, as is known in the art.

The present invention also includes fuel products that include a reaction product of a mixture including carbonaceous fine particles and a binder composition including a distillable petroleum hydrocarbon emulsified with a surfactant and water. The binder is preferably present in an amount sufficient to provide a hydrophobic surface to said particles. Preferably, the fuel product contains the binder composition in an amount between about 1.5 and about 4.0 percent by weight. The amount of binder composition can be determined by the amount necessary to bring about a statistically significant change in the chemistry of the carbonaceous materials to be bound. This statistically significant change is the increase in C—O groups when the carbonaceous particles are compared to the bound carbonaceous particles by FTIR (Fourier Transform Infrared Spectroscopy).

The fuel products produced according to this method have increased hydrophobic (water hating) character. In theory, it is believed that the low viscosity distillable hydrocarbons used in this invention coat coal particles after emulsion separation causing the coal particles to increase in hydrophobic (water heating) character. Asphalt binders, on the other hand, have been shown not to coat the carbonaceous materials, but to simply draw them together thereby leaving a large surface areas of the materials in the same hydrophilic condition. The increased hydrophobic character of the materials treated with this invention enables the bound particles to be cured without a costly drying step. Because it is low in moisture without the additional drying step, synfuel products produced are less expensive to manufacture an more stable than the products produced using the prior art. Further, the synfuel product manufactured in accordance with this invention can be stored without absorbing as much water as the products produced using the prior art. This allows the user to have uniform BTU feedstock for their furnace and not to loose BTU value while the feedstock is in storage.

Referring again to FIG. 1, the present invention further includes methods for making fuel from fine carbonaceous materials. The methods include exposing the carbonaceous materials to a binder composition, the binder composition including a distillable petroleum hydrocarbon emulsified with a surfactant and water. In one embodiment the binder composition is present between about 1.0 percent and 4.0 percent of the total weight of the fuel. In yet another embodiment, the binder composition is present between about 2.0 and 3.0 percent of the total weight of the fuel. It is conceivable that more or less binder composition may be applied to the carbonaceous material. Factors that may influence the amount of material added include the amount of time the binder composition is applied, how the binder composition is exposed to the carbonaceous material or the particular surface area of the carbonaceous material to be bound. If all these factors are optimum, less than 1.0 percent of the binder may be required. If, on the other hand, there are exposure difficulties, more than 4.0 percent may required.

In another embodiment, chemical additives to improve fuel burning characteristics are added. In one preferred embodiment, the chemical additive includes NaOH, which functions as a fusing additive to reduce particulate matter emissions from the stack. In still another embodiment the fuel is solidified by conventional means into a briquette or pellet by conventional means.

The present invention shall be more correctly explained with the following examples which are to be considered merely representative of the present invention and, thus, should not be considered as limiting.

EXAMPLES

Example 1

Nuclear Magnetic Resonance of Coal

Figure 3:
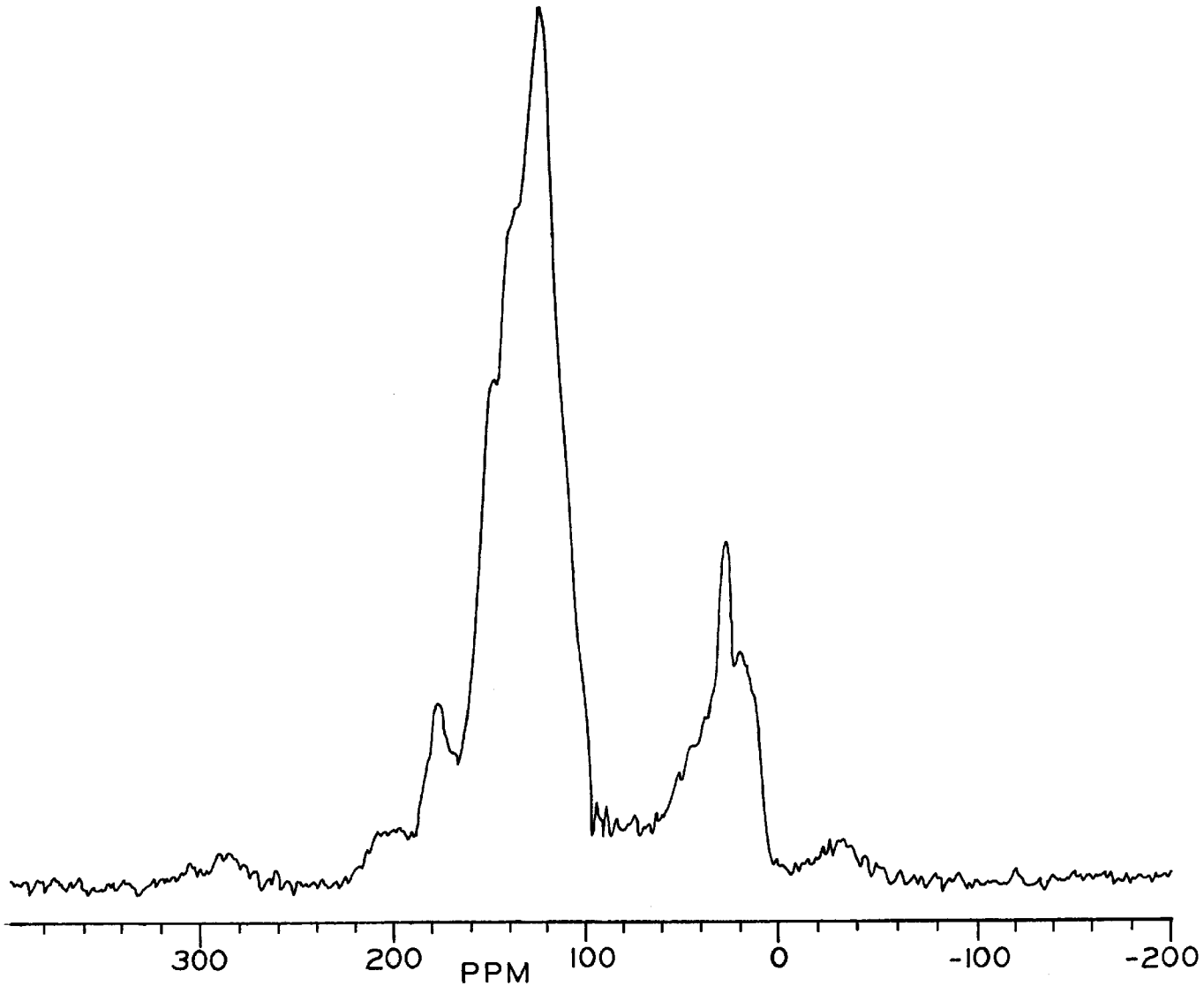
FIG. 3 is the NMR Spectrum of a raw coal sample.
Figure 4:
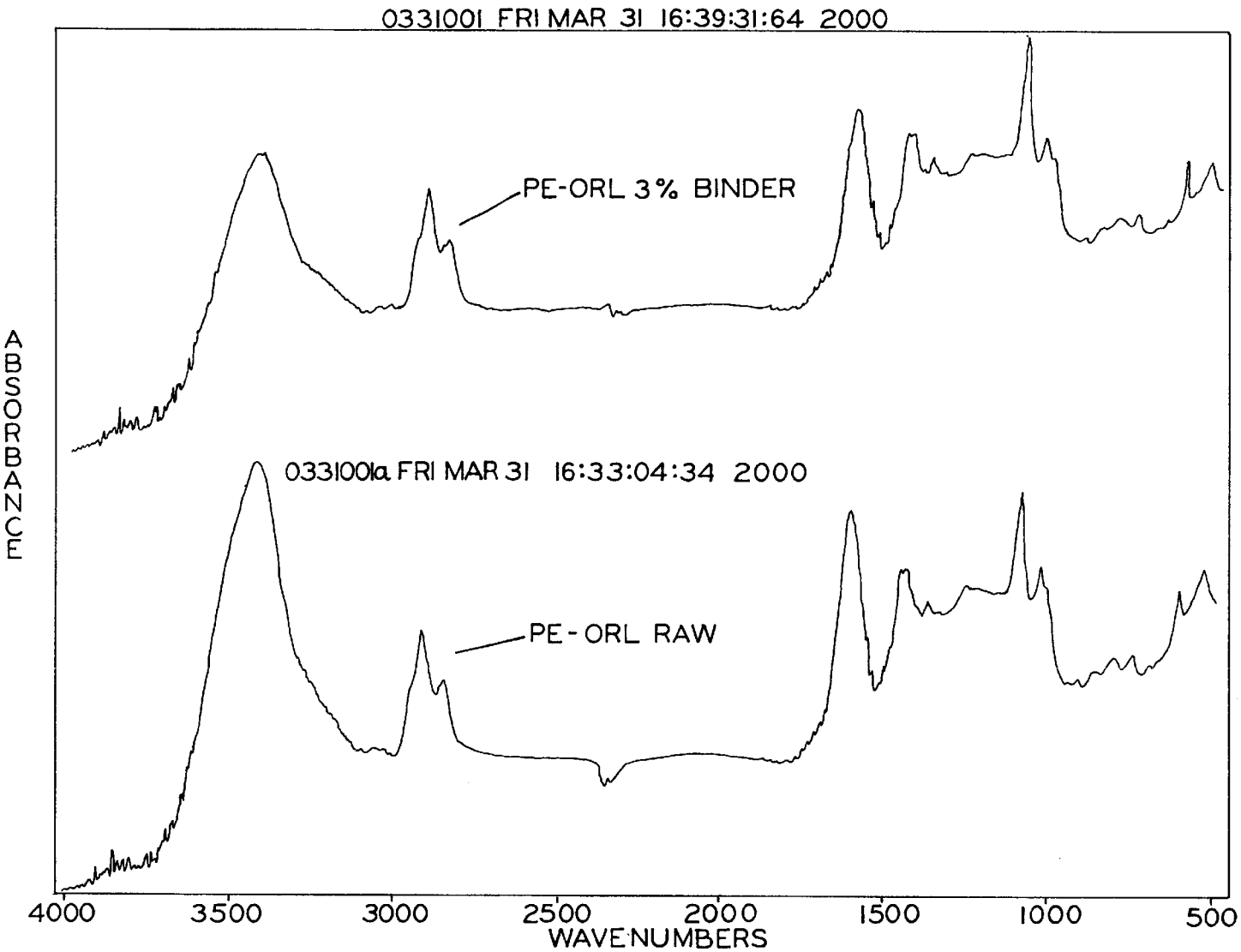
FIG. 4 is the FTIR comparison of unbound PE-ORL coal versus bound PE-ORL coal with 3% binder.
Figure 5:
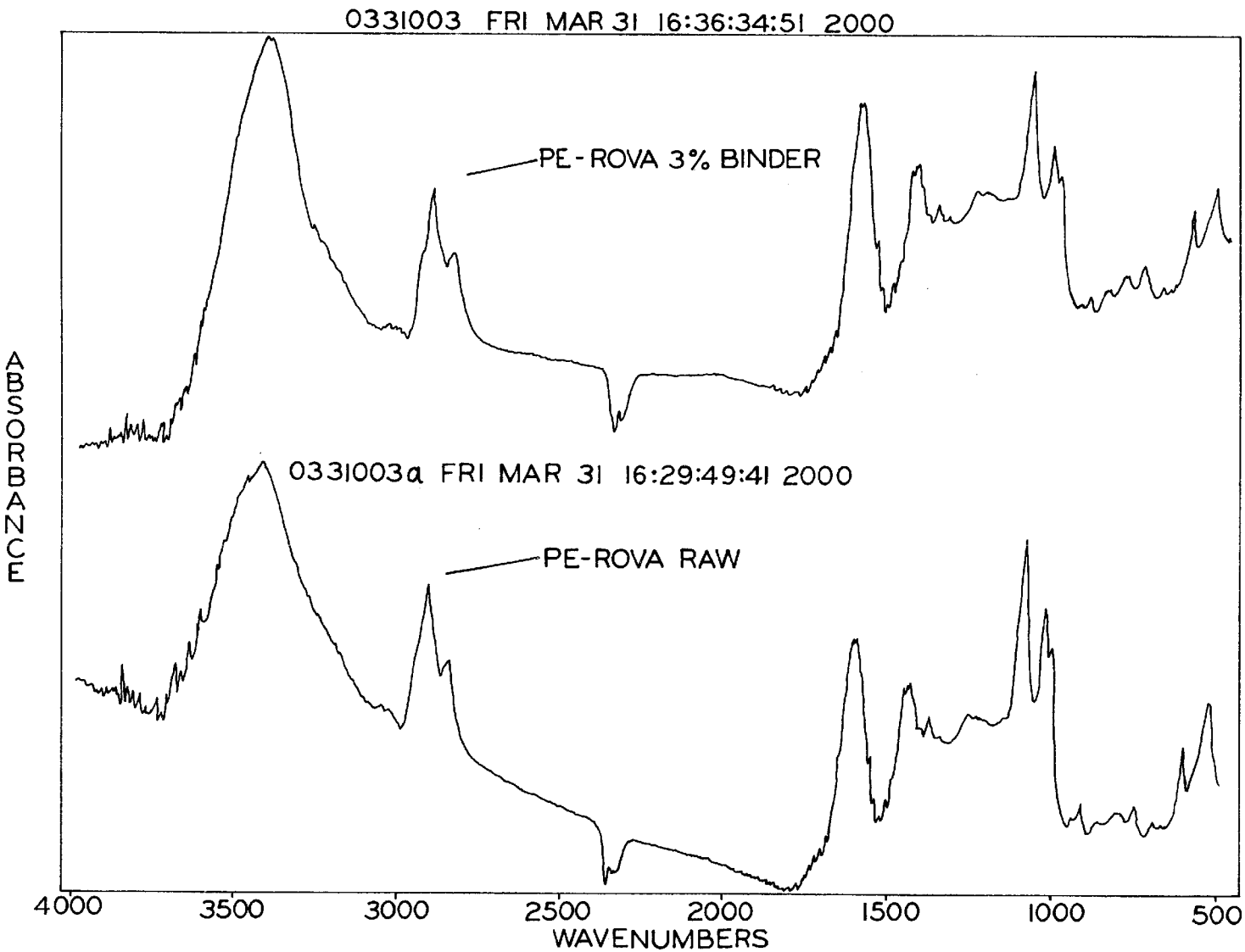
FIG. 5 is the FTIR comparison of unbound PE-ROVA coal versus bound PE-ROVA coal with 3% binder.
Figure 6:
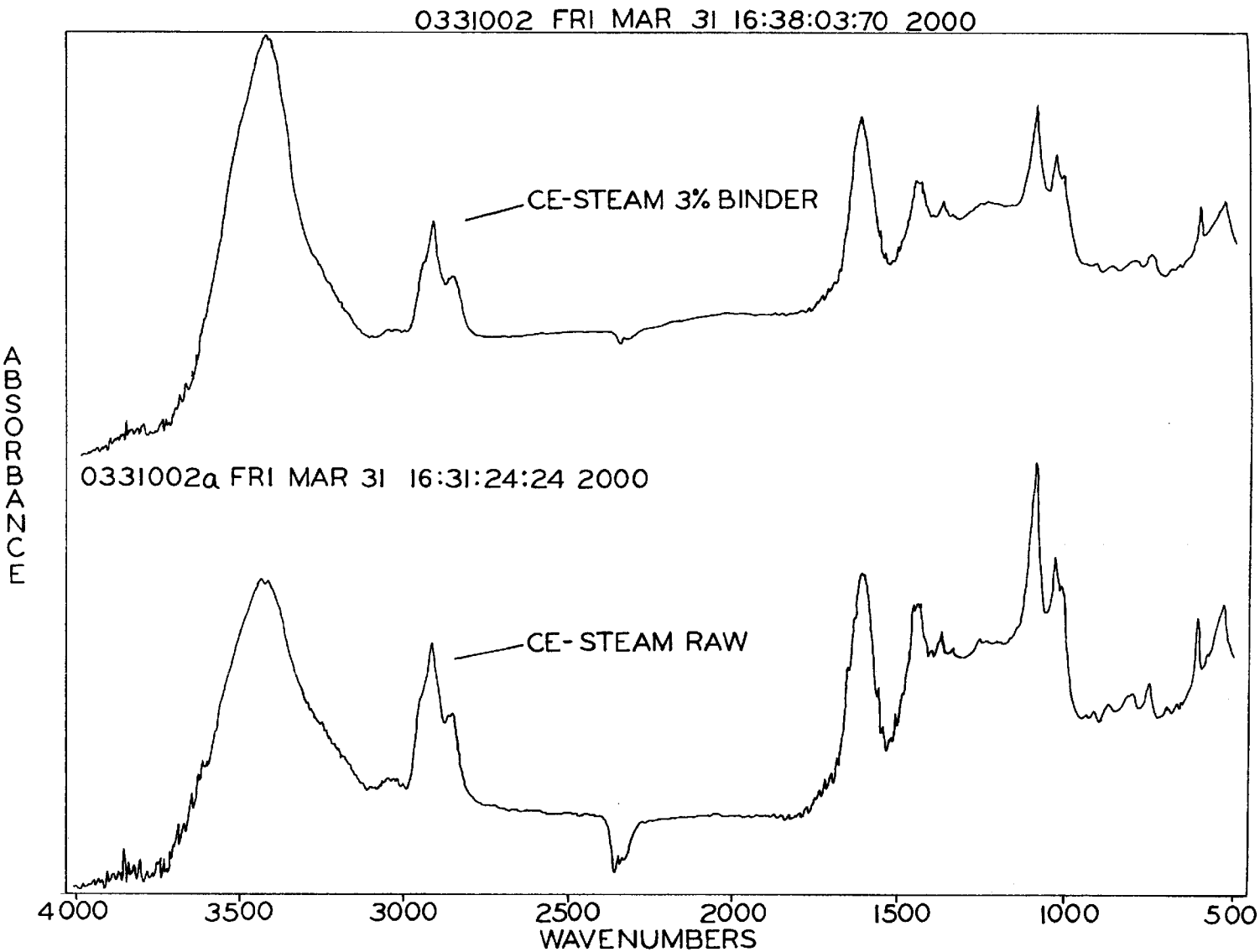
FIG. 6 is the FTIR comparison of unbound CE-STEAM coal versus bound CE-STEAM coal with 3% binder.
Figure 7:
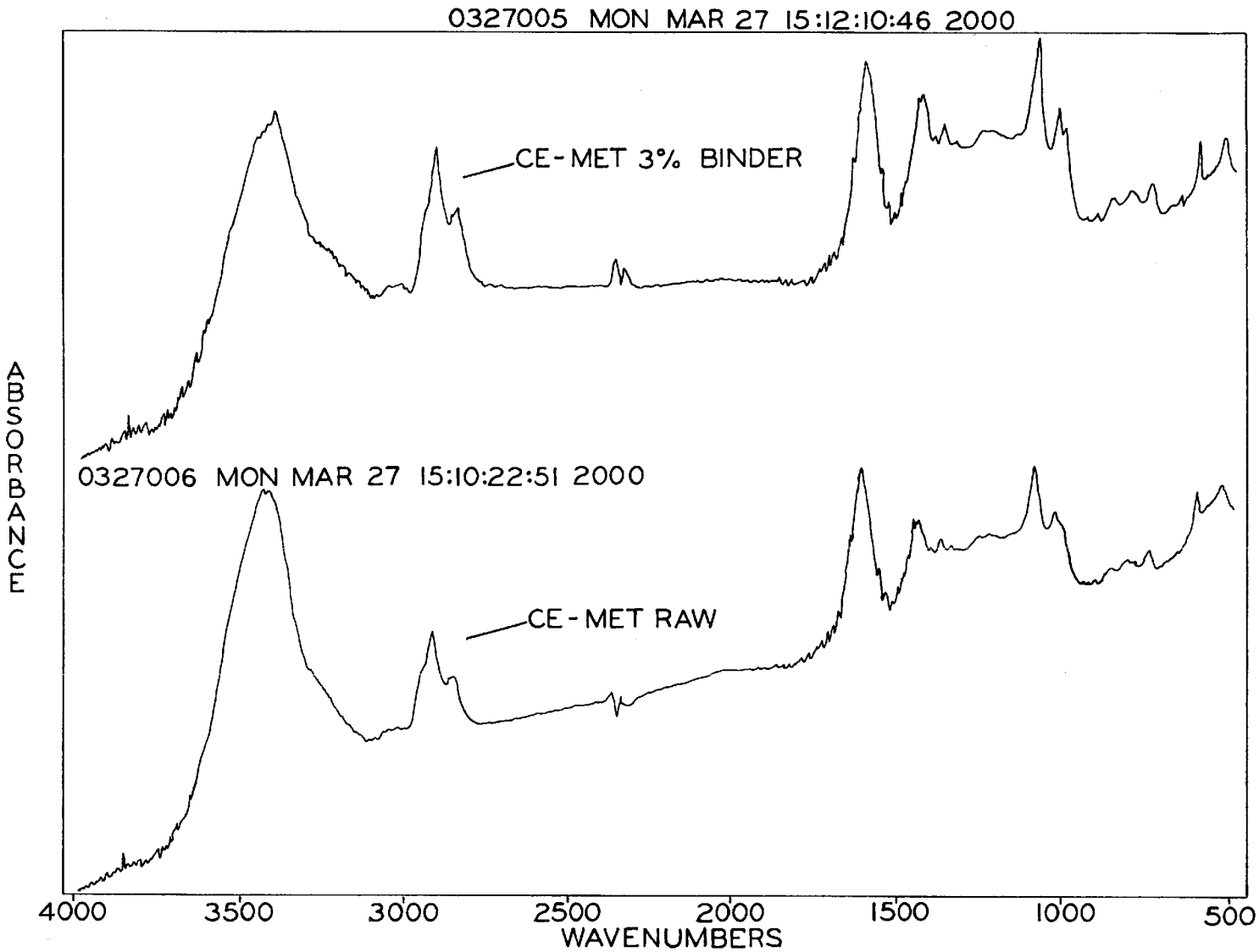
FIG. 7 is the FTIR comparison of unbound CE-MET coal versus bound CE-MET coal with 3% binder.
Figure 8:
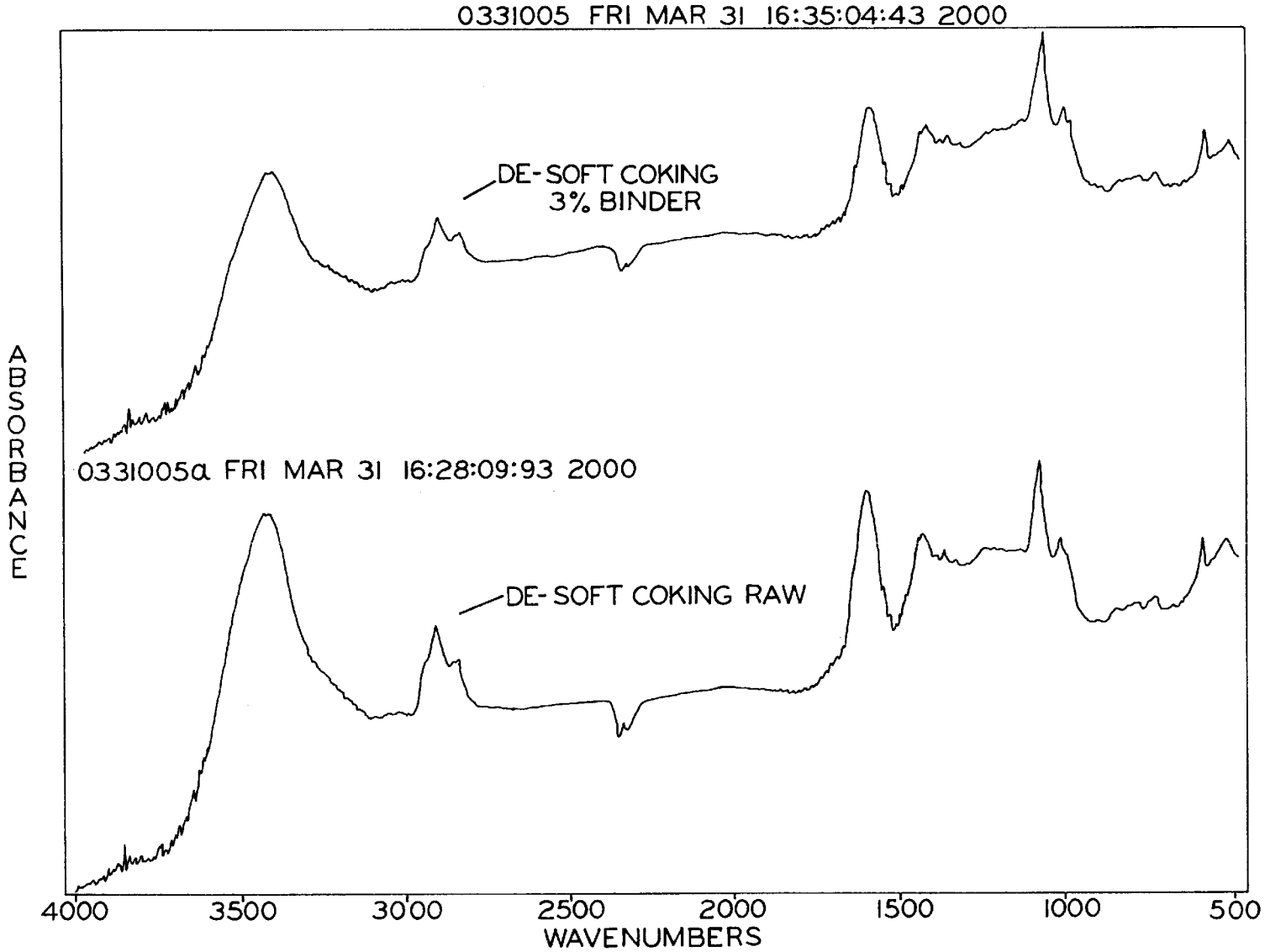
FIG. 8 is the FTIR comparison of unbound DE-Soft Coking coal versus bound DE-Soft Coking coal with 3% binder.

A raw coal sample was studied with Nuclear Magnetic Resonance as is known in the art. FIG. 3 depicts the Nuclear Magnetic Resonance spectrum for coal and shows the polar, hydrophilic characteristics of coal before treatment with the binders of this invention to obtain a hydrophobic surface chemistry.

Example 2

Preparation of Synthetic Fuel 1. 1000 g of #6 Fuel Oil was heated to 77 C. (170° F.).
2. A surfactant mix was prepared by:
   (a) Heating 660 g of water to 38 C. (100° F.);
   (b) Mixing 2.5 g of NaOH into the water;
   (c) Mixing 20 g of Tall Oil fatty acid into the caustic water.
3. The fuel oil and surfactant mix was blended at approximately 40% mix/60% fuel oil in a colloid mill to prepare a binder emulsion.
4. Coal fines are mixed with the binder emulsion in an amount of about 2% to 3% by weight to produce synthetic fuel.

Example 3

Typical Properties of Binders

The properties of a sample of binder composition prepared according to this invention were evaluated. The properties and the tests used for each are shown in Table 1.

TABLE 1

Properties of Binder Composition

| Test | | Typical Property | Method |
|---|---|---|---|
| BTU/lb | Wet | >10,500 | ASTM D240 |
| | Dry | >17,500 | |
| Ash % (dry) | | <0.5 | ASTM D482 |
| Sulfur % (wet) | | ≦0.75 | ASTM D1552 |
| Volatile Matter % | Wet | >90 | ASTM D3175 |
| | Dry | >55 | |
| Moisture % | | ≦40 | ASTM D244 |
| Sieve % | | ≦0.1 | ASTM D244 |

Example 4

Short Proximate and Ultimate Analysis of Binder

Short Proximate and Ultimate Analysis was performed on a sample of a binder according to this invention. The Short Proximate Analysis was performed according to ASTM D 3173 and the Ultimate Analysis was performed according to ASTM D 3176. The results are shown in Table 2.

TABLE 2

| | HES Binder |
|---|---|
| Short Proximate Emulsions | |
| % Moisture | 35.0 |
| % Residue | 65.0 |
| % Ash | <.001 |
| BTU/lb (dry) | 17,650 |
| % Sulfur (dry) | .98 |
| Ultimate Analysis | |
| % Total Moisture | 35.0 |
| % Carbon | 55.90 |
| % Hydrogen | 6.76 |
| % Nitrogen | <.001 |
| % Sulfur | 0.65 |
| % Ash | <.001 |
| % Oxygen (diff.) | 1.68 |

Example 5

Analysis of Binder for Polynuclear Aromatic Hydrocarbons

The binder sample of Example 4 was tested for Polynuclear Aromatic Hydrocarbon (PAH) compounds. PAH determinations were made using EPA Method SW 846-8310. The results are shown in Table 3.

TABLE 3

| PAH's, mg/kg | HES Binder |
|---|---|
| Naphthalene | BDL |
| Acenaphthylene | BDL |
| Aceneaphthene | BDL |
| Flourene | BDL |
| Phenanthrene | 1.6 |
| Anthracene | 0.3 |
| Flouranthene | 0.2 |
| Pyrene | 0.4 |
| Benzo(a)anthracene | 0.5 |
| Chrysene | 1.2 |
| Benzo(b)flouranthene | 0.3 |
| Benzo(k)flouranthene | 0.1 |
| Benzo(a)pyrene | 0.2 |
| Dibenzo(a,h)anthracene | 0.1 |
| Benzo(g,h,i)perylene | 0.4 |
| Indeno(1,2,3-cd)pyrene | BDL |

Example 6

Sulfur Forms in Binder Emulsion

The binder sample of Example 4 was tested to determine Sulfur forms. The Sulfur forms include Sulfate Sulfur, Pyrtitic Sulfur and Organic Sulfur. The sample was tested according to ASTM D 2492. Organic Sulfur is calculated by the difference to total Sulfur using ASTM D 4239. The Organic Sulfur was further characterized by GC/MS. The results are shown in Table 4.

TABLE 4

| Sulfur Forms in Binder | % by Weight |
|---|---|
| Sulfur Forms | |
| Sulfate Sulfur | <0.01 |
| Pyritic Sulfur | <0.01 |
| Organic Sulfur | 0.79 |
| Total Sulfur | 0.81 |

TABLE 4-continued

| Sulfur Forms in Binder | % by Weight |
|---|---|
| Organic Forms of Sulfur | |
| Organic Sulfur | 0.79 |
| Thiophenes | 0.77 |
| Sulfones | 0.02 |

Example 7

Leachability of Binder Emulsion

A binder emulsion residue prepared according to this invention was evaluated for leachability in an EPA certified laboratory. The test methods are listed below.

| Test | Method Procedure |
|---|---|
| TCLP Procedure | SW 846-1311 |
| Volatiles | SW 846-8240 |
| Semi-Volatiles GC/MS | SW 846-3510 |
| Polynuclear Aromatic Hydrocarbons | SW 846-8310 |
| Metals | SW-846-3010 |

The leachate results on metals are summarize in Table 5. The leachate volatiles are listed in Table 6. The leachate semi-volatiles are listed in Table 7. The polynuclear aromatic compounds (PACs) are presented in Table 8.

TABLE 5

Leachate Results (TCLP) for Metals (mg/l)

| Description | HES | Det. Limit |
|---|---|---|
| BARIUM | BDL | 0.05 |
| CADMIUM | BDL | 0.05 |
| CHROMIUM | BDL | 0.05 |
| LEAD | BDL | 0.25 |
| SILVER | BDL | 0.05 |
| ARSENIC | BDL | 0.05 |
| SELENIUM | BDL | 0.05 |

TABLE 6

Volatile Organics ($\mu$g/L)

| Description | HES | Det. Limit |
|---|---|---|
| BENZENE | BDL | 50 |
| CARBON TETRACHLORIDE | BDL | 50 |
| CHLOROBENZENE | BDL | 50 |
| CHLOROFORM | BDL | 50 |
| 1,2-DICHLOROETHANE | BDL | 50 |
| 1,1-DICHLOROETHYLENE | BDL | 50 |
| METHYL ETHYL KETONE | BDL | 100 |
| TETRACHLOROETHYLENE | BDL | 50 |
| TRICHLOROETHYLENE | BDL | 50 |
| VINYL CHLORIDE | BDL | 100 |

TABLE 7

TCLP Semi-Volatile Organics (μg/L)

| Description | HES | Det. Limit |
|---|---|---|
| 1,4-DICHLOROBENZENE | BDL | 50 |
| 2,4-DINITROTOLUENE | BDL | 50 |
| HEXACHLOROBENZENE | BDL | 50 |
| HEXACHLOROBUTADIENE | BDL | 50 |
| HEXACHLOROETHANE | BDL | 50 |
| NITROBENZENE | BDL | 50 |
| PYRIDINE | BDL | 250 |
| 2-METHYL PHENOL | BDL | 50 |
| 3-METHYL PHENOL | BDL | 50 |
| 4-METHYL PHENOL | BDL | 50 |
| PENTACHLOROPHENOL | BDL | 250 |
| 2,4,5-TRICHLOROPHENOL | BDL | 50 |
| 2,4,6-TRICHLOROPHENOL | BDL | 50 |

TABLE 8

Polynuclear Aromatic Hydrocarbons by HPLC (μg/L)

| Description | HES | Det. Limit |
|---|---|---|
| NAPHTHALENE | BDL | 50 |
| ACENAPHTHYLENE | BDL | 50 |
| ACENAPHTHENE | BDL | 50 |
| FLUORENE | BDL | 50 |
| PHENANTHRENE | BDL | 50 |
| ANTHRACENE | BDL | 50 |
| FLUORANTHENE | BDL | 50 |
| PYRENE | BDL | 50 |
| BENZ(A)ANTHRACENE | BDL | 50 |
| CHRYSENE | BDL | 50 |
| BENZO(B)FLUORANTHENE | BDL | 50 |
| BENZO(K)FLUORANTHENE | BDL | 50 |
| BENZO(A)PYRENE | BDL | 50 |
| DIBENZO(A,H)ANTHRACENE | BDL | 50 |
| BENZO(G,H,I)PERYLENE | BDL | 50 |
| INDENO(1,2,3-CD)PYRENE | BDL | 50 |

Comments

1. No metals leached above the detection level.
2. No volatiles were found in the leachate above the detection level.
3. The semi-volatiles were not found above the level of detection.
4. The PACs were not found above the level of detection.

Conclusions

This study found that the binder emulsion residues prepared according to this invention had no leachable compounds of concern above the level of detection. Based on this testing, the binder would not be expected to leach measurable compounds of concern.

Example 8

Metal Analysis of Binder

A 10 g sample of a binder composition of this invention was ashed in accordance with ASTM D482. The ashed metal oxides were digested in acid using method SW846-3050, and metals were analyzed using ICP following SW 846-6010. The results of the metal analysis are shown in Table 9.

TABLE 9

| Metal | Result (mg/kg) | Detection Limit (mg/kg) |
|---|---|---|
| Silver | BDL | 5 |
| Aluminum | BDL | 25 |

TABLE 9-continued

| Metal | Result (mg/kg) | Detection Limit (mg/kg) |
|---|---|---|
| Arsenic | BDL | 5 |
| Boron | BDL | 5 |
| Barium | BDL | 5 |
| Beryllium | BDL | 5 |
| Calcium | 15 | 10 |
| Cadmium | BDL | 5 |
| Cobalt | BDL | 5 |
| Chrome | BDL | 5 |
| Copper | BDL | 5 |
| Iron | 18 | 10 |
| Magnesium | BDL | 10 |
| Manganese | BDL | 5 |
| Mercury | BDL | 20 |
| Molybdenum | BDL | 5 |
| Sodium | 8000 | 25 |
| Nickel | BDL | 5 |
| Lead | BDL | 5 |
| Antimony | BDL | 5 |
| Selenium | BDL | 5 |
| Tin | BDL | 5 |
| Strontium | BDL | 5 |
| Titanium | BDL | 10 |
| Vanadium | 8.0 | 5 |
| Zinc | BDL | 10 |

The assay shows trace levels of iron and vanadium. The source is from the water used to make the binder emulsion. The sodium is from the surfactant. The formula predicts about 8300 mg/kg, which is close to the reported value.

Because the binder is used at a low percentage level of the total coal-binder mixture, the contribution of the metals to the coal is very small. For example, if the coal binder is 4% of the mixture, then the contribution of iron to the coal is 18 mg/kg×0.4=0.7 mg/kg.

Example 9

Short Proximate Analysis and FTIR Comparison of Raw and Treated Coal

Five Samples of Coal were treated with 3% binder emulsion prepared according to this invention. The samples were evaluated for Short Proximate Analysis as is known in the art and described in the tables below and FTIR both before and after treatment with the binder. The results of the experiments are indicated in the Table 10 below and FIGS. 4–8.

TABLE 10

Short Proximate Analysis of Five Coal Samples Before and After Treatment with Binder

| | As Received | Dry Basis | As Received | Dry Basis |
|---|---|---|---|---|
| | PE - Orl Raw | | PE Orl 3% Binder | |
| % Moisture | 2.82 | xxx | 3.89 | xxx |
| % Ash | 6.72 | 6.92 | 6.35 | 6.61 |
| Btu/lb | 13,500 | 13,892 | 13,500 | 14,046 |
| % Sulfur | 1.08 | 1.11 | 1.14 | 1.19 |
| | CE - Steam Raw | | CE-Steam 3% Binder | |
| % Moisture | 6.20 | xxx | 7.31 | xxx |
| % Ask | 8.14 | 8.68 | 7.09 | 7.65 |
| Btu/lb | 13,500 | 14,392 | 13,200 | 14,241 |
| % Sulfur | .97 | 1.03 | .97 | 1.05 |
| | PE - Rova Raw | | PE - Rova 3% Binder | |
| % Moisture | 4.02 | xxx | 5.10 | xxx |
| % Ash | 7.06 | 7.36 | 6.70 | 7.06 |
| Btu/lb | 13,200 | 13,752 | 13,200 | 13,909 |
| % Sulfur | 1.23 | 1.28 | 1.39 | 1.46 |

TABLE 10-continued

| Short Proximate Analysis of Five Coal Samples Before and After Treatment with Binder | | | | |
|---|---|---|---|---|
| | As Received | Dry Basis | As Received | Dry Basis |
| | CE - Met Raw | | CB - Met 3% Binder | |
| % Moisture | 3.62 | xxx | 4.71 | xxx |
| % Ash | 6.33 | 6.57 | 5.99 | 6.29 |
| Btu/lb | 13,900 | 14,422 | 14,000 | 14,691 |
| % Sulfur | .55 | .57 | .74 | .78 |
| | PE - Soft Coking Raw | | PE - Soft Coking 3% Binder | |
| % Moisture | 6.02 | xxx | 7.14 | xxx |
| % Ash | 5.05 | 5.37 | 4.92 | 5.30 |
| Btu/lb | 13,300 | 14,152 | 13,200 | 14,215 |
| % Sulfur | .84 | .89 | .79 | .85 |

As shown in Table 10, percent moisture after treatment with the binder was insignificantly higher than percent moisture of the raw starting material. As with the raw materials all of the moisture was removed upon drying. In all cases, treatment with the binder resulted in a lower percentage of ash. The BTU was similar to that of the raw material with the Btu/lb value decreasing slightly in one case and remaining the same or increasing in each of the other cases. Sulfur concentration was also not affected much by treatment with the binder emulsion.

The FTIR spectra for the five samples shows that at approximately $1110^{-CM}$, the C—O response is significantly higher for the bound material than the starting material.

Treatment with the binder emulsion resulted in a product with properties similar or enhanced with respect to the starting coal material. The binders of the present invention produce a high quality product that is not compromised with respect to moisture retention, ash content, Btu/lb or sulfur content.

Example 10

Short Proximate Analysis and FTIR Comparison of RAG Sample

A RAG coal sample was screened at 12.5 mm (½ inch) prior to testing. The material larger than 12.5 mm (½ inch) was discarded. After screening, the sample was mixed with 2.5%, 3.0% and 3.5% binder for FTIR testing. Short Proximate Analysis was performed on the 3.0% samples because it had been previously determined that varying the binder content by 0.5% has only a slight effect on the results.

Figure 9:
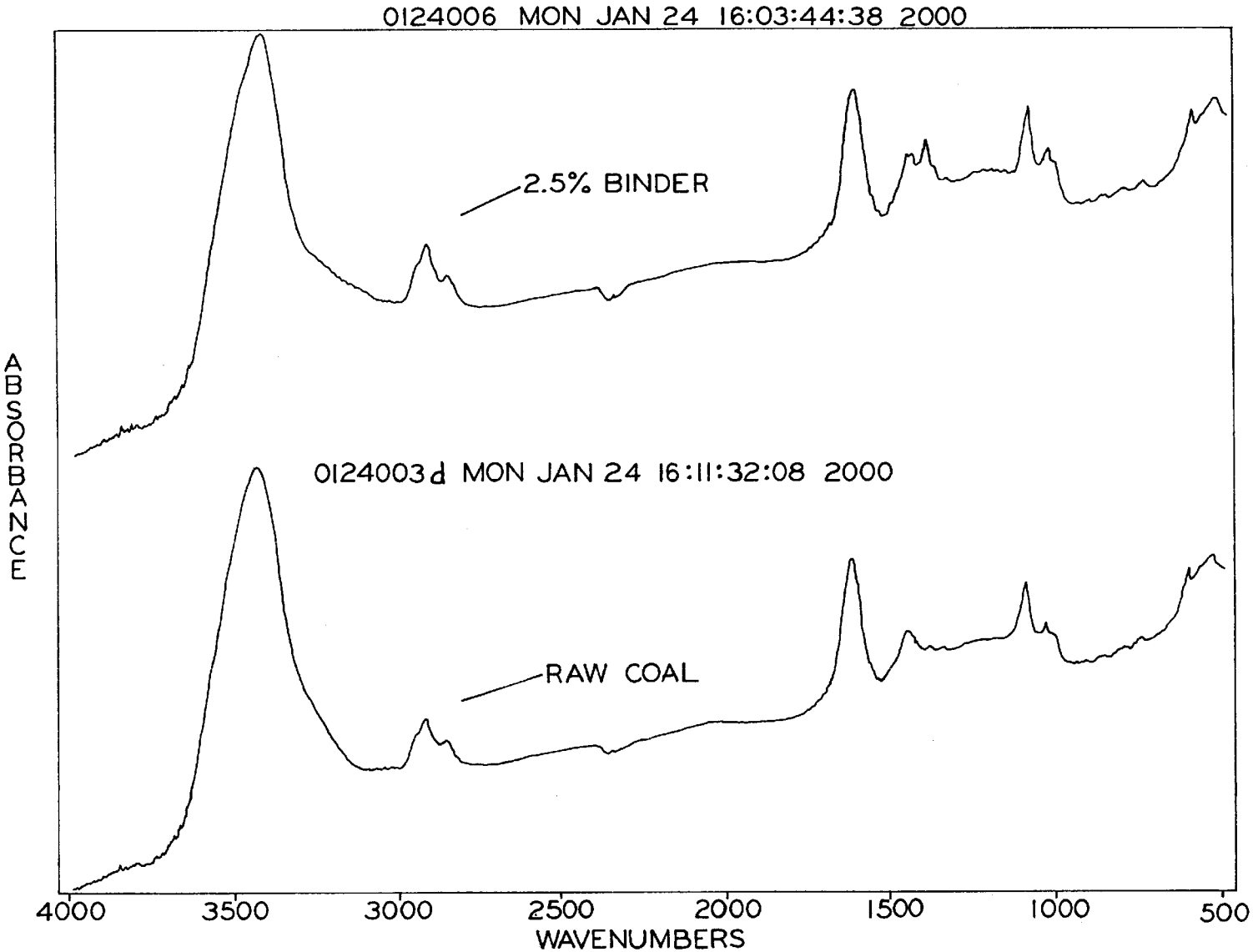
FIG. 9 is the FTIR comparison of unbound RAG coal versus bound RAG coal with 2.5% binder.
Figure 10:
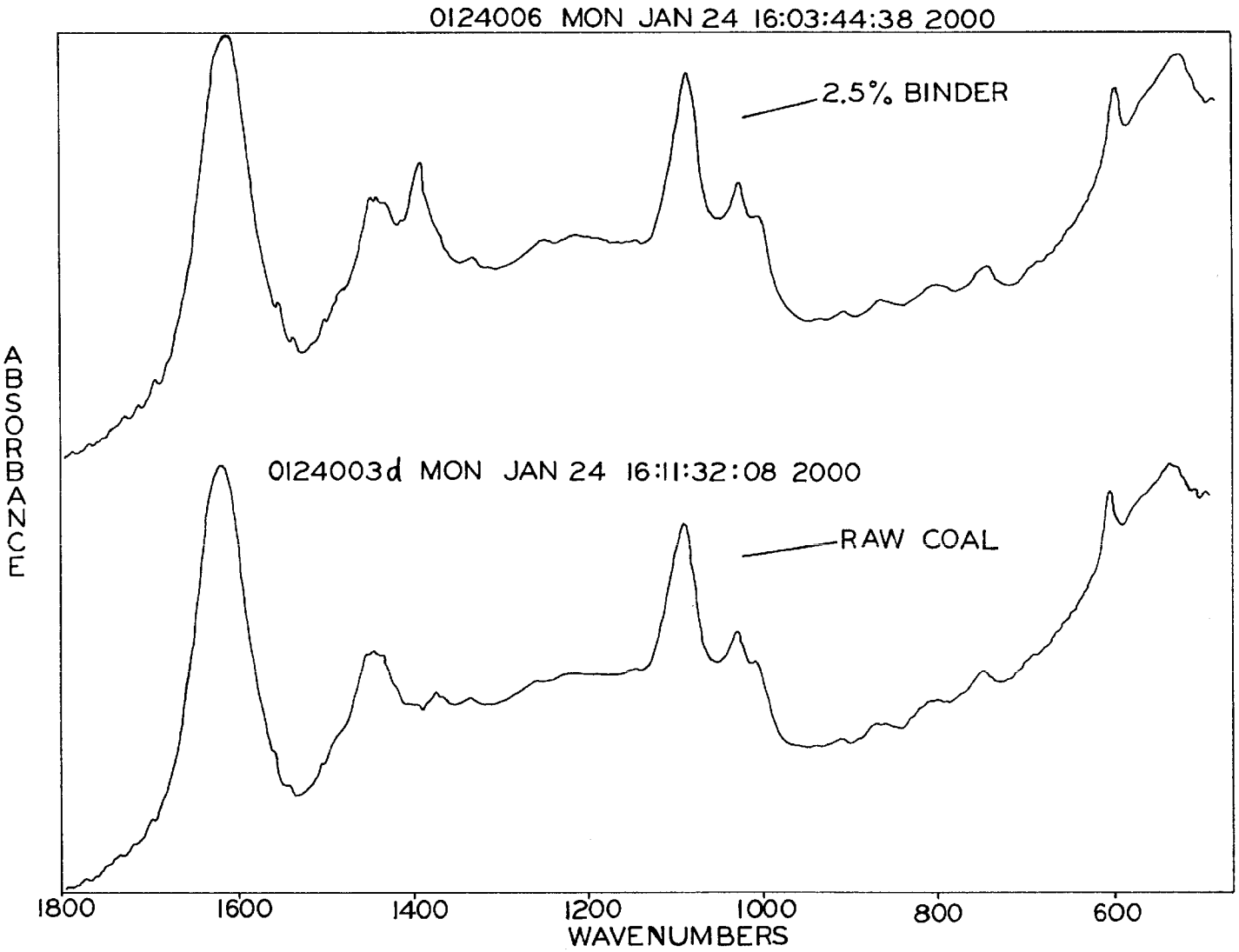
FIG. 10 is a focused view of the C—O region of the RAG coal versus bound RAG coal with 2.5% binder.

The results are shown in Table 11 and FIGS. 9 and 10.

TABLE 11

| Short Proximate Analysis of RAG Sample Before and After Treatment with Binder RAG Coal Sample Jan. 27, 2000 | | | | |
|---|---|---|---|---|
| | Short Proximate Analysis | | | |
| | Parent Coal (As Received) | Parent Coal (Dry Basis) | RAG w/ 3% HES (As Received) | RAG w/ 3% HES (Dry Basis) |
| % Moisture | 6.44 | xxxx | 6.94 | xxxx |
| % Ash | 6.95 | 7.43 | 7.29 | 7.83 |
| Btu/lb | 13,454 | 14,380 | 13,113 | 14,091 |
| % Sulfur | 2.25 | 2.40 | 2.57 | 2.76 |

TABLE 11-continued

| Short Proximate Analysis of RAG Sample Before and After Treatment with Binder RAG Coal Sample Jan. 27, 2000 | |
|---|---|
| Sample Gradation | |
| Sieve Size, in. | % Passing |
| 2.5 | 100 |
| 2.0 | 100 |
| 1 1/2 | 100 |
| 1.0 | 95.5 |
| 3/4 | 86.5 |
| 1/2 | 73.5 |
| 3/8 | 66.2 |
| No. 4 | 44.0 |
| No. 8 | 12.2 |

The RAG sample when processed as listed above with 2.5% binder shows changes in the FTIR spectra when compared to raw coal. The area in the 500–1800 $cm^{-1}$ was expanded and included to more clearly show these changes. The percent moisture, ash and sulfur did not significantly increase after treatment with a binder of this invention. The Btu/lb was mostly preserved in the treated sample.

Example 11

Short Proximate Analysis and FTIR Comparison of HCP Sample

A HCP coal sample was screened at 12.5 mm (½ inch) prior to testing. The material larger than 12.5 mm (½ inch) was discarded. After screening, the sample was mixed with 2.5%, 3.0% and 3.5% binder for FTIR testing. Short Proximate Analysis was performed on the 3.0% samples because it had been previously determined that varying the binder content by 0.5% has only a slight effect on the results.

Figure 11:
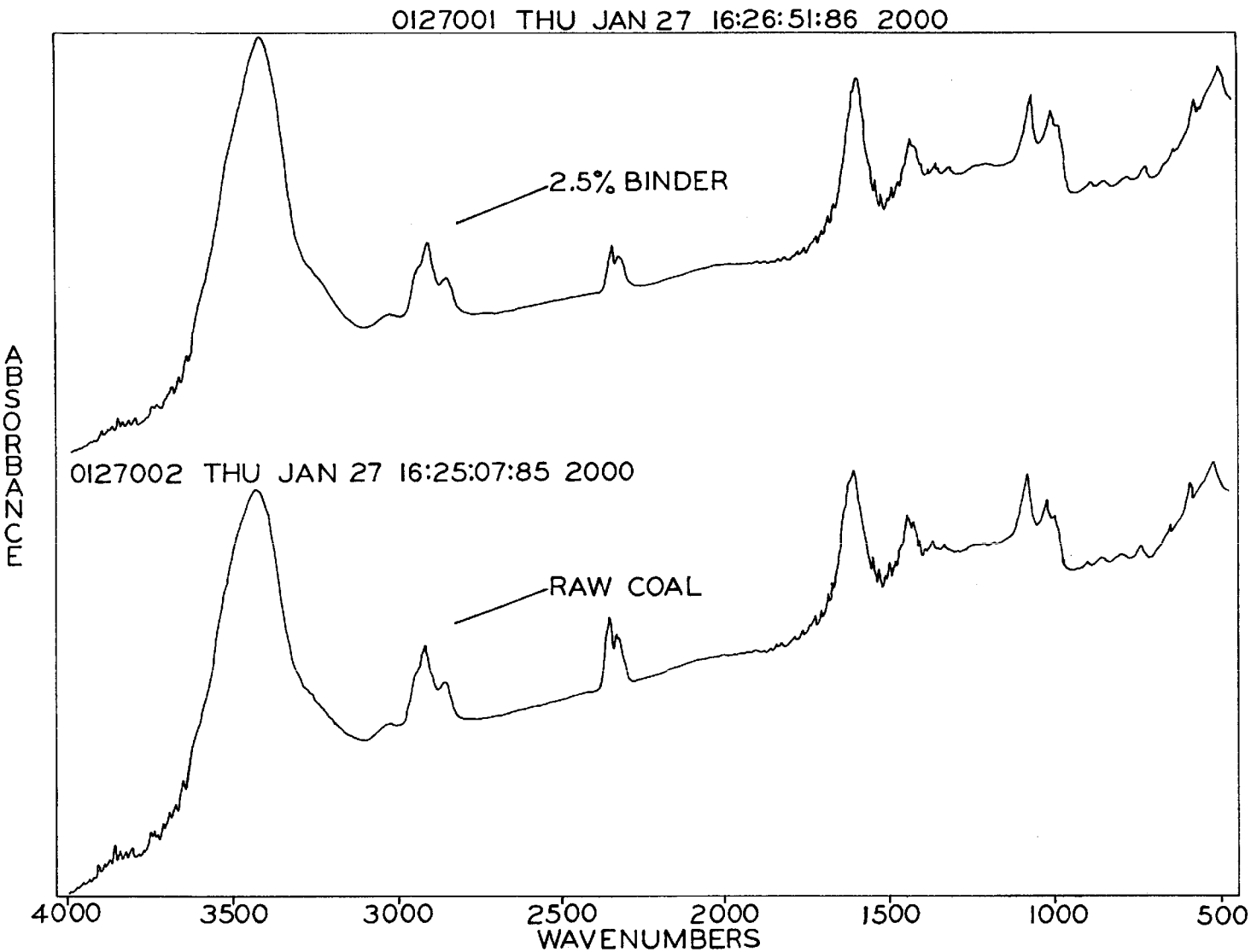
FIG. 11 is the FTIR comparison of unbound HCP coal versus bound HCP coal with 2.5% binder.
Figure 12:
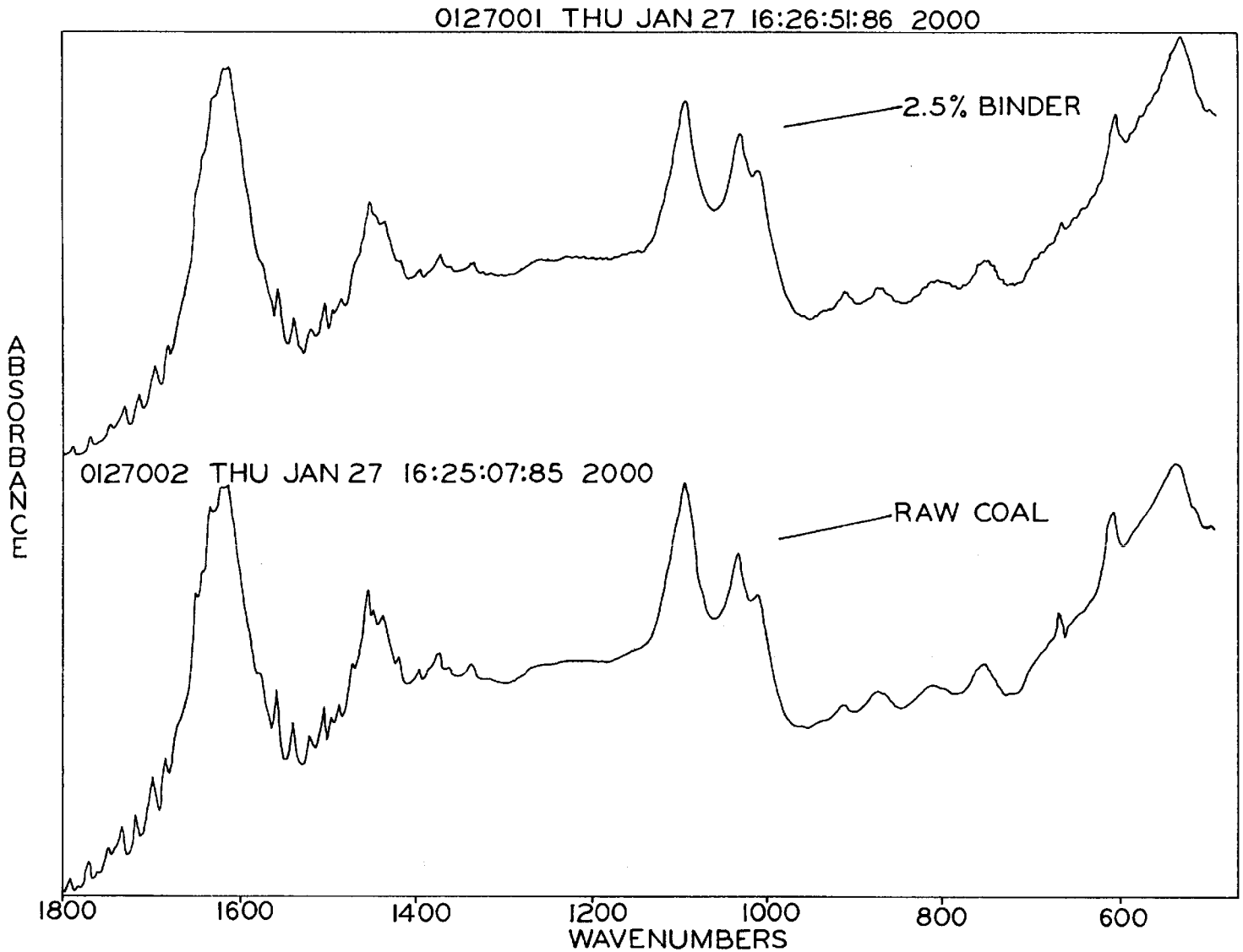
FIG. 12 is a focused view of the C—O region of the HCP coal versus bound HCP coal with 2.5% binder.

The results are shown in Table 12 and FIGS. 11 and 12.

TABLE 12

| Short Proximate Analysis of HCP Sample Before and After Treatment with Binder HCP Coal Sample Jan. 27, 2000 | | | | |
|---|---|---|---|---|
| | Short Proximate Analysis | | | |
| | Parent Coal (As Received) | Parent Coal (Dry Basis) | RAG w/ 3% HES (As Received) | RAG w/ 3% HES (Dry Basis) |
| % Moisture | 6.80 | xxxx | 7.45 | xxxx |
| % Ash | 8.20 | 8.80 | 8.96 | 9.68 |
| Btu/lb | 13,064 | 14,017 | 12,859 | 13,894 |
| % Sulfur | 2.19 | 2.35 | 2.31 | 2.50 |

| Sample Gradation | |
|---|---|
| Sieve Size, in. | % Passing |
| 2.5 | 100.0 |
| 2.0 | 97.4 |
| 1 1/2 | 97.4 |
| 1.0 | 97.4 |
| 3/4 | 96.3 |
| 1/2 | 89.8 |
| 3/8 | 84.9 |
| No. 4 | 67.3 |
| No. 8 | 29.5 |

The HCP sample when processed as listed above with 2.5% binder shows changes in the FTIR spectra when compared to raw coal. The area in the 500–1800 $cm^{-1}$ was expanded and included to more clearly show these changes. The percent moisture, ash and sulfur did not significantly increase after treatment with a binder of this invention. The Btu/lb was mostly preserved in the treated sample.

Example 12

Moisture Absorption by Drop Test Comparison

The raw coal samples were passed through a #4 (4.75 mm) sieve. Any material retained on the #4 sieve was crushed and added back to the feed material. The sample was then dried in an oven set at 120° C. (248° F.) for 3 hours to simulate the pre-drying step utilized in the field. One sample was treated with an asphalt based binder and the second sample was mixed with the liquid petroleum binder of this invention. Both treated samples were processed using a Komareck B-100R briquetting machine. A third sample of raw coal was untreated.

The moisture absorption characteristics of each sample was then measured using a drop test as follows. The samples were weighed and then submerged in water for a standard amount of time. Excess water was wiped from each sample. The samples were then weighed again. The increase in weight is reported as a percent of the entire weight of the sample. Samples with high percentages retain water and are considered hydrophilic, while samples with low percentages retain little water and are considered hydrophobic.

TABLE 13

Hydrophobic Character Comparison

| Coal Sample and Preparation | Percent Water Gain |
|---|---|
| Raw Coal | 13.42 |
| Coal bound with Asphalt binder | 4.39 |
| Coal bound with #6 Fuel Oil binder of this invention | 0.4 |
| Coal bound with Crankcase Oil binder and nonionic surfactant of this invention | 1.19 |
| Coal bound with Crankcase Oil binder and cationic surfactant of this invention | 1.14 |
| Coal bound with Crankcase Oil binder and anionic surfactant of this invention | 1.41 |

Raw coal retained a high percentage of water as expected. The asphalt binder resulted in a lower percentage of water gain than raw coal. Coal treated with the binders of this invention showed much lower water gain than coal treated with the asphalt binder.

Example 13

Hydrophobic Character Comparison by Contact Angle

Four samples of coal; Alabama Bituminous, Kentucky Bituminous, Lignite, and Sub-Bituminous were evaluated in both the raw and briquetted form. The raw coal samples were passed through a no. 4 (4.75 mm) sieve. Any material retained on the no. 4 was crushed and added back to the feed material. Each sample was then dried in an oven set at 120 C. (248 F.) for 3 hours to simulate the pre-drying step utilized in the field. The samples were then mixed with a liquid binder and pelletized.

The surface of each sample was exposed to a drop of water. The contact angle was measured at various time points. Contact angle is the measure of the angle between a droplet placed on the surface and the surface itself. A low contact angle suggests that the liquid easily wets the surface. Conversely, if the material beads up, the contact angle is high, showing a dislike for the surface (hydrophobicity). Hydrophobic surfaces tend to have a high contact angle that is stable over a period of time. The contact angle data for each raw and treated sample is shown below. In each case, the raw samples had an initially low contact angle that degraded quickly showing that the surface of the coal is relatively hydrophilic. Each sample treated according to this invention, however, had a high contact angle that was stable for at least one minute. Thus, the treated samples had hydrophobic surfaces.

TABLE 14

Contact Angle Data for Lignite

| | Lignite | |
|---|---|---|
| Time (sec) | Raw | Briquette |
| 0.5 | 87.4261 | |
| 0.55 | | 106.052 |
| 2.8 | 52.0663 | |
| 4.2 | 23.648 | |
| 4.62 | | 106.08 |
| 6.6 | | 106.347 |
| 8.68 | | 106.3 |
| 10.77 | | 106.161 |
| 12.86 | | 109.324 |
| 14.83 | | 106.171 |
| 16.92 | | 106.146 |
| 19.01 | | 106.137 |
| 21.1 | | 106.135 |
| 23.18 | | 106.12 |
| 25.27 | | 106.09 |
| 27.36 | | 105.772 |
| 29.44 | | 105.987 |
| 31.53 | | 105.96 |
| 33.62 | | 105.907 |
| 35.71 | | 105.955 |
| 37.79 | | 105.92 |
| 39.88 | | 105.251 |
| 42.02 | | 105.213 |
| 44.11 | | 105.152 |
| 46.2 | | 105.118 |
| 48.28 | | 105.07 |
| 50.37 | | 104.931 |
| 52.46 | | 104.867 |
| 54.55 | | 105.011 |
| 56.63 | | 104.958 |
| 58.83 | | 104.979 |
| 60.92 | | 104.907 |

TABLE 15

Contact Angle Data for Sub-Bituminous

| | Sub-Bituminous | |
|---|---|---|
| Time (sec) | Raw | Briquette |
| 0.56 | 87.3479 | 118.136 |
| 0.55 | | |
| 2.53 | 85.3679 | |
| 2.54 | | 118.112 |
| 4.62 | 84.2928 | 118.032 |
| 6.65 | 82.4996 | |
| 6.71 | | 117.993 |
| 8.74 | | 117.937 |
| 8.8 | 81.0583 | |
| 10.83 | 79.7327 | 117.929 |
| 12.92 | | 115.069 |
| 12.97 | 78.1926 | |
| 15 | 76.624 | |
| 15.01 | | 115.042 |
| 17.09 | | 114.929 |
| 17.14 | 74.5511 | |
| 19.18 | | 117.731 |
| 19.23 | 72.6941 | |
| 21.27 | | 117.667 |
| 21.32 | 70.9697 | |
| 23.35 | | 114.82 |
| 23.41 | 68.1559 | |
| 25.44 | | 117.608 |
| 25.49 | 65.4821 | |
| 27.47 | | 117.598 |

TABLE 15-continued

Contact Angle Data for Sub-Bituminous

| | Sub-Bituminous | |
|---|---|---|
| Time (sec) | Raw | Briquette |
| 27.58 | 62.2965 | |
| 29.51 | | 117.601 |
| 29.67 | 59.4453 | |
| 31.59 | | 117.625 |
| 31.86 | 57.3079 | |
| 33.62 | | 117.587 |
| 34.06 | 53.2249 | |
| 35.71 | | 117.612 |
| 36.26 | 49.0604 | |
| 37.8 | | 117.595 |
| 38.46 | 44.3069 | |
| 39.89 | | 117.608 |
| 40.65 | 38.9616 | |
| 41.97 | | 117.591 |
| 42.85 | 33.3715 | |
| 44.06 | | 114.734 |
| 45.05 | 27.4457 | |
| 46.15 | | 114.714 |
| 47.35 | 20.4583 | |

TABLE 16

Contact Angle Data for Alabama Bituminous

| | Alabama Bituminous | |
|---|---|---|
| | Raw | Briquette |
| 0.55 | | 113.31 |
| 0.56 | 73.2927 | |
| 2.8 | | 113.424 |
| 3.3 | 63.9644 | |
| 5.11 | | 113.858 |
| 6.16 | 58.7375 | |
| 7.42 | | 113.401 |
| 9.07 | 53.8598 | |
| 9.78 | | 111.644 |
| 11.92 | 46.6121 | |
| 12.09 | | 109.115 |
| 14.5 | | 106.509 |
| 14.89 | 39.0522 | |
| 16.92 | | 105.77 |
| 17.91 | 30.0441 | |
| 19.78 | | 105.006 |
| 20.93 | 19.9972 | |
| 22.19 | | 102.612 |
| 24.61 | | 102.602 |
| 27.03 | | 102.502 |
| 29.39 | | 104.396 |
| 31.8 | | 104.469 |
| 34.22 | | 102.589 |
| 36.69 | | 103.277 |
| 39.16 | | 103.726 |
| 41.58 | | 102.168 |
| 44 | | 105.037 |
| 46.47 | | 103.822 |
| 48.94 | | 105.026 |
| 51.36 | | 106.19 |
| 53.83 | | 105.107 |
| 56.3 | | 104.32 |
| 58.77 | | 103.942 |
| 61.19 | | 103.882 |
| 63.66 | | 102.158 |
| 66.08 | | 105.281 |
| 68.55 | | 105.612 |
| 71.02 | | 103.951 |
| 73.55 | | 107.894 |
| 73.55 | | 107.894 |

TABLE 17

Contact Angle Data for Kentucky Bituminous

| | Kentucky Bituminous | |
|---|---|---|
| | Raw | Briquette |
| 0.56 | 38.5678 | 102.975 |
| 2.76 | | 103.086 |
| 2.86 | 27.4562 | |
| 4.15 | 15.468 | |
| 4.95 | | 102.07 |
| 7.15 | | 101.764 |
| 9.4 | | 101.762 |
| 11.65 | | 102.79 |
| 13.85 | | 102.746 |
| 16.54 | | 102.009 |
| 18.85 | | 100.886 |
| 21.1 | | 101.233 |
| 23.41 | | 101.638 |
| 26.15 | | 100.907 |
| 28.9 | | 102.01 |
| 31.21 | | 102.42 |
| 34.06 | | 101.836 |
| 36.37 | | 102.545 |
| 38.68 | | 101.383 |
| 41.53 | | 101.725 |
| 43.95 | | 102.07 |
| 46.81 | | 101.755 |
| 49.11 | | 101.118 |
| 51.97 | | 101.864 |
| 54.82 | | 100.778 |
| 57.24 | | 101.041 |
| 60.1 | | 101.098 |

Example 14

Opacity Reduction

The opacity of stack emissions was compared upon burning raw coal, coal treated according to this invention and then raw coal again. The results are summarized below in Table 18.

TABLE 18

Opacity Reduction

| STEP | FUEL | OPACITY REDUCTION |
|---|---|---|
| 1 | Raw Coal | 0% |
| 2 | Treated Coal | 50% |
| 3 | Raw Coal | 0% |

Coal treated according to this invention shows a fifty percent reduction in stack emissions opacity. Therefore, use of the present invention will lead to cleaner air.

The results of these examples demonstrate the invention overcomes the shortcomings of the prior art. Accordingly, this invention provides a more effective binder for briquetting coal fines than was previously available. In particular, the invention is partially based on the objective of producing a coal binder that reacts chemically with the coal particles constituting the briquette, thereby producing a more stable and cohesive briquette.

The invention further provides, as demonstrated by the example data, a coal binder, which is low in the pollutant sulfur, that can be used to produce a solid product correspondingly low in sulfur. Unlike the prior art, when the invention is used to bind coal fines, the resulting low sulfur product can be used industrially without contributing to sulfur stack emissions. Also, unlike the prior art, this invention provides a bound solid final product which produces little ash when combusted or incinerated. Because the product of this invention, when used as a fuel source, produces low ash and sulfur emissions, it is ideal for industrial use.

The hydrophobic/hydrophilic data obtained by the drop test and contact angle measurements demonstrated the synfuel product manufactured according to this invention has increased hydrophobic character over the prior art and raw coal.

The coal binder can be produced from waste material, thereby reducing the overall costs of the raw materials constituting the solid product. These materials may be derived from various hydrocarbon waste streams including, used motor oil and other waste stream petroleum distillates. The fines used to form the solid product can include those fines recovered from the coke or coal industry as well as blast furnace revert materials or valuable fines heretofore unknown. The prior art, on the other hand, incorporates expensive polymers and acids to solidify fines, which significantly contributes to the cost manufacturing. If used in this fashion this invention can be used to alleviate a long standing environmental problem, transforming waste material into a viable fuel products.

The present invention can also be used in conjunction with ongoing coking operations to substantially avoid or largely alleviate the formation of waste coke stream. Presently, about 10% of the coke ovens waste is fine material that is discarded but can be used for the present process to form useful coke articles. The fine coke breeze discharged from the coking ovens can be solidified using the invention. If desired, the entire output of the coke oven could be ground or otherwise crushed or pulverized and solidified using this invention to a uniform size. Once a uniform size, the fuel can be used in a more predictable manner. In either case, a waste stream of fine carbon coke breeze is not produced and recovery of the discarded coke breeze is avoided. This application also permits the use of low quality coke, which form high proportions of coke breeze.

While the invention has been described in detail in the foregoing description and examples, the same is to be considered as illustrative and not restrictive in character, it being understood that only the preferred embodiments have been shown and described, and that all changes and modifications that come within the spirit of the invention are desired to be protected.

What is claimed is:

1. Agglomerated fuel particles comprising agglomerated particles of carbonaceous material fines, selected from the group consisting of coke breeze, coke fines, finely divided metallurgic coke, coal fines, revert materials and mixtures thereof, produced by:

a) contacting individual particles of the carbonaceous material fines with an emulsion, said emulsion being:
   (i) produced by emulsifying a distillable liquid petroleum hydrocarbon having a flash point greater than 120° C. with a surfactant and from about 25 weight percent to about 75 weight percent water, based upon the total weight of the distillable liquid petroleum hydrocarbon, surfactant and water to form said emulsion; and
   (ii) in a sufficient amount so that said individual particles of the carbonaccous material fines are coated with said distillable liquid petroleum hydrocarbon and coated surfaces of said individual particles of the carbonaceous material fines are rendered hydrophobic; and b) allowing the distillable liquid petroleum hydrocarbon component of the emulsion to coat the individual particles of the carbonaceous material fines to thereby render the coated surfaces of said individual particles of the carbonaceous material fines hydrophobic.

2. Agglomerated fuel particles according to claim 1, further comprising forming the agglomerated fuel particles into at least one of briquettes and pellets.

3. A method for making agglomerated fuel particles which comprise agglomerated particles of carbonaceous material fines, said method comprising:

providing a plurality of individual particles of carbonaceous mineral fines, selected from the group consisting of coke breeze, coke fines, finely divided metallurgic coke, coal fines, revert materials and mixtures thereof;

providing an emulsion produced by emulsifying a distillable liquid petroleum hydrocarbon having a flash point greater than 120° C. with a surfactant and from about 25 weight percent to about 75 weight percent water, based upon the total weight of the distillable liquid petroleum hydrocarbon, surfactant and water to form said emulsion:

combining the individual particles of carbonaceous material fines with the emulsion; and allowing the distillable liquid petroleum hydrocarbon component of the emulsion to coat said individual particles of carbonaceous material fines to thereby render coated surfaces of said individual particles of carbonaceous material fines hydrophobic.

4. A method according to claim 3, wherein the emulsion is present in an amount between about 1.0 percent to about 4.0 percent of the total weight of the carbonaceous material fines and emulsion.

5. A method according to claim 4, wherein the emulsion is present in an amount between about 2.0 percent to about 3.0 percent of the total weight of the carbonaceous material fines and emulsion.

6. A method according to claim 3, wherein the emulsion further comprises an additive for reducing ash emissions.

7. A method according to claim 3, further comprising forming the agglomerated fuel particles into at least one of briquettes and pellets.

8. A method according to claim 3, wherein said distillable liquid petroleum hydrocarbon is a fuel oil, lubricating oil, bright stocks, vacuum distillates, coal based gas oils or mixtures thereof.

9. A method according to claim 3, wherein said distillable liquid petroleum hydrocarbon is present in said emulsion in an amount of from about 25 weight percent to about 70 weight percent and said surfactant is present in said emulsion in an amount of from about 0.25 weight percent to about 5 weight percent.

10. A method according to claim 3, wherein said emulsion further comprises a base.

11. A method according to claim 10, wherein said base comprises sodium hydroxide.

12. A method according to claim 3, wherein said surfactant is an anionic surfactant.

13. A method according to claim 12, wherein said surfactant comprises a fatty acid, a rosin acid, tall oil, tallow fatty acids, lignosulfanates or mixtures thereof.

14. A method according to claim 3, wherein said surfactant comprises a cationic surfactant.

15. A method according to claim 14, wherein said surfactant comprises diamines, quaternary amine salts or mixtures thereof.

16. A method according to claim 3, wherein said surfactant is a nonyl phenyl.

* * * * *